United States Patent [19]

Yates

[11] 3,943,801

[45] Mar. 16, 1976

[54] TOOL SET WITH SLIDE-OUT AND SWING-OUT TOOLS

[76] Inventor: Harmon P. Yates, P.O. Box 511, Longview, Wash. 98632

[22] Filed: Feb. 24, 1975

[21] Appl. No.: 552,697

[52] U.S. Cl. ..... 81/71
[51] Int. Cl.[2] ..... B25B 13/48
[58] Field of Search ..... 81/71, 177 R

[56] References Cited

UNITED STATES PATENTS

| | | | |
|---|---|---|---|
| 2,475,268 | 7/1949 | Wittle | 81/71 |
| 2,633,768 | 4/1953 | Saxby | 81/71 |
| 2,715,028 | 8/1955 | Dossie | 81/71 |
| 2,776,744 | 1/1957 | Cook | 81/71 |

*Primary Examiner*—James L. Jones, Jr.
*Attorney, Agent, or Firm*—Kolisch, Hartwell, Dickinson & Stuart

[57] ABSTRACT

A tool set including a plurality of tools each having a pair of integrally connected elongate shanks disposed at an angle relative to each other and an elongate tool-holding body having a channel open along one of its longitudinal sides and at one of its ends for storing the tools therein with one shank of each tool supported on the base of the channel. A pivot member extending laterally of the channel and spaced outwardly from the base of the channel overlies the shanks of the tools in the channel. A tool is slidable longitudinally of the body to shift one tool shank outwardly to expose a working part thereon and the pivot member permits swinging of the other tool shank outwardly to expose a working part thereon. A frictional, shank-engaging clip engages the shanks of the tools in the channel to hold them either in stored or selected working positions relative to the body. The tools decrease in cross-sectional dimensions progressing from one to the other laterally of the channel. The base of the channel and the overlying pivot member converge on progressing laterally of the channel to produce a selected sliding fit with the tools, also serving to inhibit rotation of the tools about axes extending longitudinally of the holding body.

13 Claims, 5 Drawing Figures

TOOL SET WITH SLIDE-OUT AND SWING-OUT TOOLS

BACKGROUND AND SUMMARY OF THE INVENTION

This invention relates to a tool set, and more particularly to a tool set including a plurality of elongate tools held in a common body in such a manner that working parts at opposite ends of the individual tools may be exposed for operation.

Workmen often find it necessary to have with them tool sets including tools of various sizes. An example of such a set are allen wrenches which are hexagonal in cross section and have varying cross sectional sizes. As is known, such allen wrenches generally have interconnected long and short shanks which are disposed substantially at right angles to each other. Although the invention will be described herein primarily with regard to allen wrenches, it should be understood that tools other than allen wrenches may be adapted to a tool set as described herein.

In the past, various holders for tool sets have been devised. However, such prior holders generally have either been expensive, bulky, of complex construction, or have not provided the required convenience of holding the tools in a manner best suited for operation.

A general object of the present invention is to provide a novel tool set including a plurality of tools, each of which has a pair of integrally connected, elongate shanks disposed at a substantial angle relative to each other and a holding body in which the tools are held either in stored or selected working positions, which set is simply and economically constructed and provides a convenient and compact tool holder for a workman.

More specifically, an object of the invention is to provide a novel tool set including a plurality of tools having elongate, angularly disposed shanks and a tool-holding body in which the tools may be held either in stored position, with one set of shanks of the tools extending longitudinally of the body and with the other set of shanks extending laterally of the body, or in selected working positions. Holding means in the body is operable either to hold the tools in their stored position, or permit manual shifting of a tool to a first working position shifted longitudinally of the body away from the other tools to expose a working portion on one shank of the tool or a second working position wherein the other shank of a tool is shifted outwardly from the body and the other tools to expose its associated working part.

A further object is to provide such a novel tool set in which a tool therein may be either shifted longitudinally of the body and away from the other tools in the set to expose one of its shanks and the working part thereon, or it may be swung about a pivot member in the body with the other shank portion extending laterally outwardly from the body to expose the working part on the other shank portion.

A still further object is to provide such a novel tool set in which a tool is held against rotation relative to the body when held in either its stored or one of its working positions, thus to be held in a selected position relative to the body for operation by a user.

Yet another object is to provide a novel tool set including a plurality of tools having integrally connected, elongate shanks disposed at substantial angles relative to each other and a holding body which compactly holds a plurality of such tools when in their stored, nonoperative position, yet which permits sliding of a tool longitudinally outwardly from the body to expose the working part on one shank of the tool or swinging of the other shank of a tool outwardly from the tool-holding body to expose the working part on such other shank.

DRAWINGS

These and other objects and advantages will become more fully apparent as the following description is read in conjunction with the drawings wherein.

DETAILED DESCRIPTION OF AN EMBODIMENT OF THE INVENTION

Figure 2:
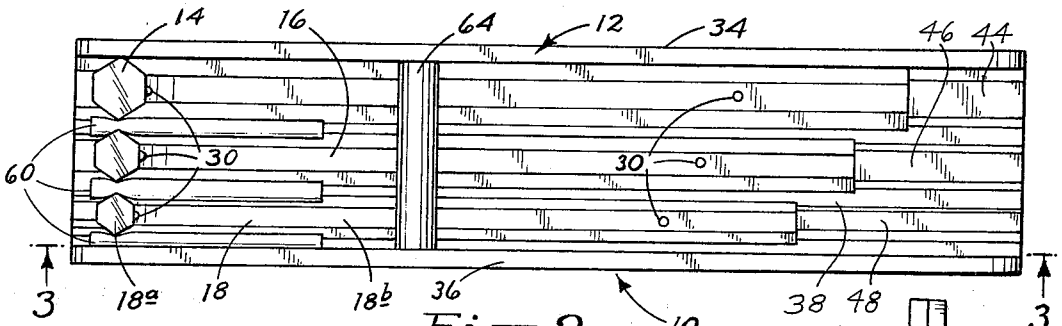
FIG. 2 is an enlarged top plan view of such a tool set.

Referring to the drawings, at 10 is indicated generally a tool set constructed according to an embodiment of the invention. Broadly speaking, the set includes an elongate tool-holding body 12 which receives and stores a plurality of tools therein such as the opposed sets of allen wrenches 14, 16, 18 on the top side of the holder as illustrated in the drawings, and second set of allen wrenches 22, 24, 26 on the bottom side of the holding body as illustrated.

As is conventional, and referring to wrench 18 for example, an allen wrench in the set has a first, or short, shank, or leg **18*a* and long, or second, shank, or leg, 18*b* disposed at substantially a right angle to each other. The two shanks are integrally connected to each other by an arcuate connecting portion 18*c*. Each of the wrenches has a hexagonal cross section, with the wrenches diminishing in cross-sectional size on progressing successively from wrench 14 to wrench 24.** Each hexagonal wrench shank has six elongate, substantially planar, angularly disposed sides extending longitudinally of the shank on a wrench. The outer ends of each of the shanks which would be inserted into the hexagonal cavity in an allen-head screw are referred to herein as the working parts on the associated shanks of the wrenches.

Figure 3:
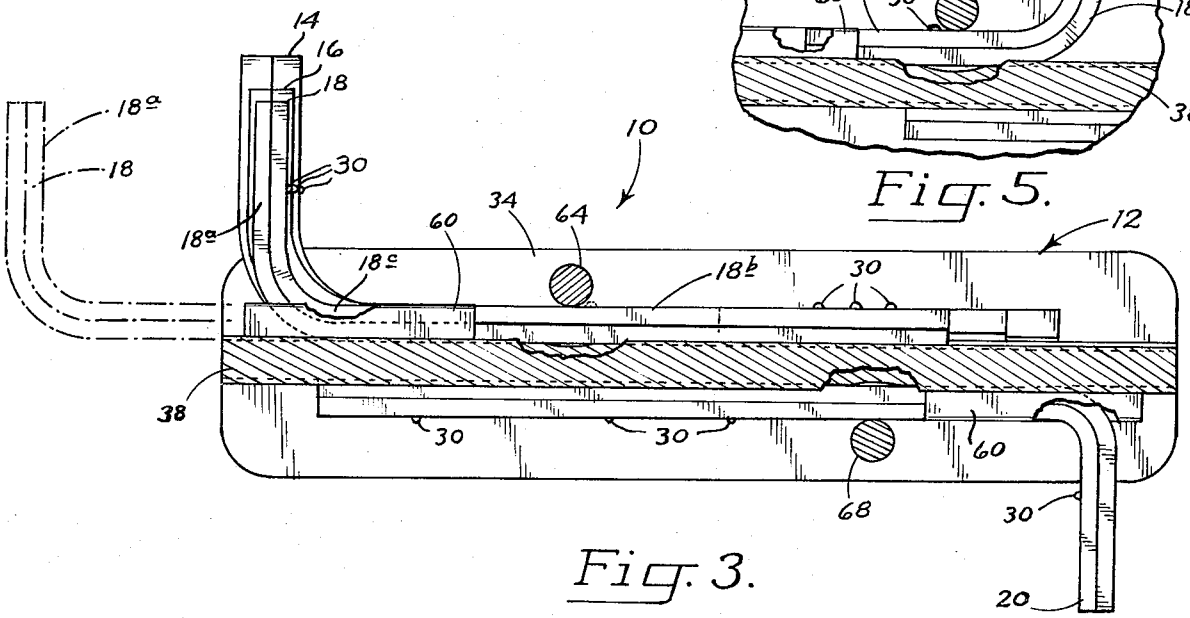
FIG. 3 is a cross-sectional view taken generally along the line 3—3 in FIG. 2.
Figure 1:
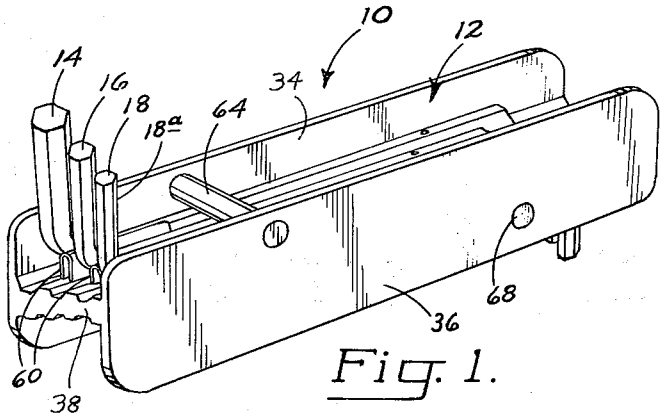
FIG. 1 is a perspective view of a tool set according to an embodiment of the invention.

As is best seen in FIGS. 2 and 3, each of the tool shanks has a projection 30 on one of its planar sides in a position spaced longitudinally inwardly on the shank from the end of the shank.

Figure 4:
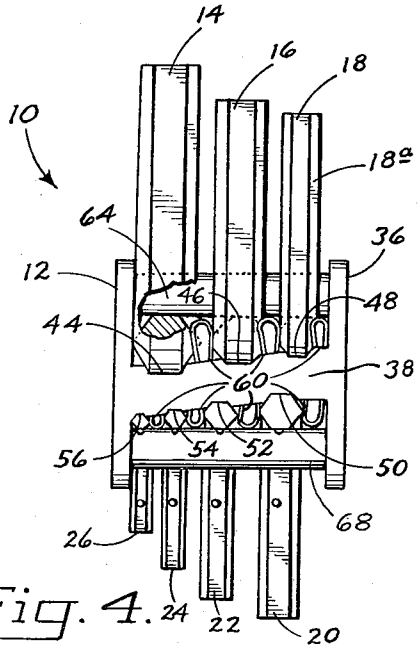
FIG. 4 is an end elevation view of the tool set.

Describing body 12, it includes a pair of elongate, substantially planar, parallel, laterally spaced side plates 34, 36. An elongate, rectangular, base plate 38, also referred to as a shank support member, extends between and is secured adjacent its opposite longitudinal margins to side plates 34, 36 intermediate the longitudinal edge margins of the side plates. As is best seen in FIG. 4, base plate 38 is disposed at an angle other than a right angle relative to side plates 34, 36. As is illustrated in FIG. 4, opposite surfaces of base plate 38 have a plurality of substantially parallel, flat-bottomed grooves 44, 46, 48, 50, 52, 54, 56 which extend fully longitudinally of the base plate and are adapted to receive and support a planar side of each of wrenches 14, 16, 18, 20, 22, 24, 26, respectively.

Side plates 34, 36 and base plate 38 define opposed sides and the base respectively, for a first channel extending longitudinally of the body in which tools 14, 16 and 18 are received, and a second channel on the opposite side of the body within which tools 20, 22, 24, 26 are received. Each channel is open along a side of the body opposite base plate 38 and at its opposite ends. The wrenches are illustrated in FIGS. 1–4 in solid outline in what is referred to herein as a stored position with a longitudinal planar side of the long shank of each wrench received in and supported in its associated groove in the base plate, and its short shank, or leg, extending normally outwardly from the base plate through the open side of the channel. The short shanks of tools 14, 16 and 18 project outwardly from holder 12 in a direction opposite the direction from which the short shanks of tools 20, 22, 24, 26 project.

A plurality of elongate spring clips 60 having a somewhat U-shaped cross section are secured to base plate 38 and project outwardly therefrom between adjacent tools in the holder. The spring clips frictionally engage sides of the wrenches yieldably to hold them in a selected position within the holder as will be explained in greater detail below.

An elongate, cylindrical pivot pin, or member, 64 extends laterally of the channel holding wrenches 14, 16 and 18 and is secured adjacent its opposite ends to side plates 34, 36 respectively. Pin 64 extends substantially normal to side plates 34, 36 and is spaced outwardly from base plate 38, whereby base plate 38 and pin 64 converge on progressing laterally of the channel in a direction from side plate 34 toward side plate 36. The spacing between base plate 38 and pivot pin 64 is such that a sliding fit is provided for wrenches 14, 16 and 18 whereby they may slide longitudinally of the holder but opposed sides of each wrench are so engaged by pin 64 on one side and the base of its associated groove on the other side as to inhibit rotation of the wrench about an axis parallelling the longitudinal axis of the holder.

An elongate, cylindrical pivot pin 68 extends between side plates 34, 36 substantially normal to the side plates and is secured adjacent its opposite ends to the side plates in the channel housing wrenches 20–26. On this side of the holder base member 38 and pivot pin 68 converge on progressing laterally of the holder from side plate 36 toward side plate 34. The spacing between base plate 38 and pivot pin 68 is such that wrenches 20–26 may slide longitudinally of the holder but opposed planar sides thereof are engaged by pivot pin 68 and the base of their associated grooves to inhibit rotation about axes extending longitudinally of the holder.

Figure 5:
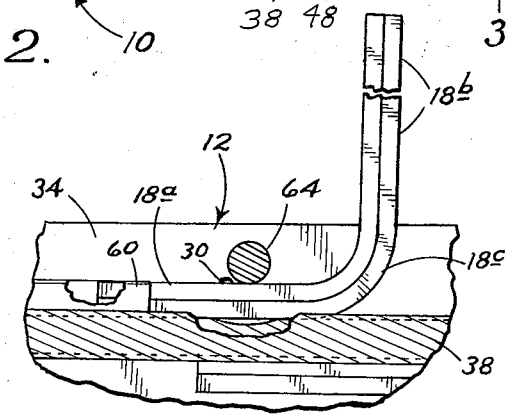
FIG. 5 is a side elevation of a portion of the tool set illustrated in FIG. 3, illustrating a tool in the set with one of its shanks swung to a position extending laterally outwardly from a tool holding body in the set.

The construction of the tool set thus described permits shifting of selected tools in the set between their compactly stored positions as illustrated in solid outline in FIGS. 1–4, a first operating position in which a tool is shifted longitudinally of the holder to expose the working part on the short shank of the tool (as illustrated in dot-dashed outline in FIG. 3), and a second working position in which the long shank of a tool is swung outwardly to a position extending substantially normal to base plate 38 (as illustrated in FIG. 5) with the working part of the long shank thus exposed for operation.

Explaining the operation of the tool set, when the wrenches are in their stored position, as illustrated in solid outline in FIGS. 1–4, spring clips 60 frictionally grip and hold a portion of the long shank of each tool adjacent its end which joins with the short shank. The pivot pin in the channel associated with the tools overlies the long shanks of the tools thus held in the spring clips to inhibit their swinging outwardly from the channel. To position the working part on the short shank portion of a tool in an exposed position for operation, a tool, such as tool 18, is manually slid longitudinally outwardly from an open end of the channel to the position illustrated in dot-dashed outline in FIG. 3. With the tool 18 thus slid longitudinally outwardly, projection 30 thereon engages pivot pin 64 to inhibit removal of the tool. The frictional force of spring clip 60 engaging tool 18 may be overcome by manual force to slide the tool outwardly to expose its working part. With the tool thus slid outwardly to a first operating position, with its working part exposed as illustrated in dot-dashed outline in FIG. 3, opposed planar sides of the long shank of the tool are still held between base member 38 and pivot pin 64 to inhibit rotation of the tool about an axis parallelling the longitudinal axis of the holder. The tool thus is able to be used by a workman to turn a part with the tool being held firmly in the holder.

Should the user desire to expose the working part at the outer end of a long shank of a tool, it is a simple matter to slide the tool longitudinally of the holder toward its associated pivot pin and at such time as the short shank comes into contact with the pivot pin to rotate the long shank outwardly and away from the base member to the position illustrated in FIG. 5 for tool 18 with its long shank extending normally outwardly from the tool holder base 38 and its short shank captured between pivot pin 64 and base plate 38. Again, a projection 30 engaging pivot pin 64 inhibits removal of the tool from the holder. Also, when the long shank portion of the tool is swung outwardly, the short shank portion comes to a position to be held by a spring clip 60 thus to prevent the short shank portion from shifting laterally in the holder and thus holding the tool against rotation to more firmly hold it for operation by a user.

Each tool in the set thus may either be held in a stored position in the holder as illustrated in solid outline in the figures, shifted longitudinally outwardly from an end of the holder to expose the working part on its short shank, or be swung outwardly from the holder to expose the working part on its long shank. In each of these positions, the tool is held by a spring clip and a portion of the tool is maintained captured between a pivot pin and base plate 38, to firmly hold the tool for convenient operation by the user.

While a preferred embodiment of the invention has been described herein, it should be apparent to those skilled in the art that variations and modifications are possible without departing from the spirit of the invention.

It is claimed and desired to secure by Letters Patent:

1. A tool set comprising a plurality of tools, each having a pair of integrally connected, elongate shanks disposed at a substantial angle relative to each other, with each shank having a working part at its outer end, an elongate tool-holding body having an elongate shank support member extending longitudinally of said body for receiving said tools and permitting manual shifting of a tool therein between a stored position held adjacent the other tools in said set with a shank thereof adjacent and extending longitudinally of said tool-holding body with one elongate side of the tool shank against said support member, a first working position shifted longitudinally of said body whereby one of said shanks of the tool is spaced from the body with its associated working part exposed, and a second working position wherein the other shank of said tool is shifted outwardly from said body and from said other tools to expose its associated working part, and holding means in said body for holding a tool in a selected position comprising a pivot member secured to said body and spaced outwardly from said shank support member, about which pivot member said tool is swingable to place said tool in its second operating position with said other tool shank extending outwardly from said shank support member and its one shank captured between said pivot member and shank support member.

2. The tool set of claim 1, wherein said holding means further comprises means for engaging and securing said one shank against shifting laterally of said body when said other tool shank extends outwardly from said shank support member.

3. A tool set comprising a plurality of tools, each having a pair of integrally connected, elongate shanks disposed at a substantial angle relative to each other, with each shank having a working part at its outer end, an elongate tool-holding body having an elongate channel defined therein extending longitudinally of said body, said channel having an elongate base with a longitudinal side of said channel opposite said base being open, said channel receiving said tools and permitting manual shifting of a tool therein between a stored position held adjacent the other tools in said set with a shank thereof adjacent and extending longitudinally of said tool-holding body and the other shank of the tool extending outwardly from said base through said open side of the channel, a first working position shifted longitudinally of said body whereby one of said shanks of the tool is spaced from the body with its associated working part exposed, and a second working position wherein the other shank of said tool is shifted outwardly from said body and from said other tools to expose its associated working part, and a pivot member secured to said body, extending laterally of said channel, spaced outwardly from said base and overlying one shank of a tool in said channel when the tool is in its stored position, said pivot member providing a pivot about which a tool may be swung to place the tool in its second working position with its said other shank extending outwardly at a substantial angle from said channel with its one shank being captured between said pivot member and the base of said channel.

4. The tool set of claim 3, which further comprises means in said channel for frictionally engaging and holding said other tool shank when said tool is in its second working position.

5. The tool set of claim 3, wherein one set of shanks of said tools are held in side-by-side, substantially parallel relationship in said channel between said base and pivot member when in their stored positions, said shanks of the tools in said set have cross-sectional dimensions which decrease progressively from one tool to the next upon progressing in one direction laterally of said channel, and said base and pivot member converge on progressing in said one direction to maintain a substantially preselected sliding fit between said tools and the base and pivot member.

6. The tool set of claim 3, which further comprises stop means for inhibiting removal of said tools from said body.

7. The tool set of claim 3, which further comprises a second channel in said body extending substantially parallel to said first-mentioned channel and opening in a direction opposite said first-mentioned channel, a second plurality of tools having angularly disposed shanks, and second holding means for holding said second set of tools in stored positions in said second channel with one set of their shanks extending substantially parallel to the base of said second channel and their other set of shanks projecting outwardly from the channel in a direction opposite the projection of said shanks in said first-mentioned set of tools.

8. The tool set of claim 7, which further comprises a second pivot member extending laterally of said second channel, spaced outwardly from the base of said second channel and overlying one shank of a tool in said second channel when the tool is in its stored position and providing a pivot about which such tool may swing to place the same in a working position with its said one shank extending outwardly at a substantial angle from said second channel with its other shank captured between said second pivot member and the base of said second channel.

9. The tool set of claim 8, which further comprises means in said second channel for frictionally engaging and holding the other shank of a tool in said second channel when said tool is in its said working position.

10. The tool set of claim 8, wherein said first and second pivot members extend substantially parallel to each other laterally of the tool-holding body, and which further comprises an elongate shank support member disposed intermediate said first and second pivot members and extending longitudinally of said body defining the bases for said first and second channels, said shank support member on progressing in one direction laterally of said tool-holding body converging on said first pivot member and diverging from said second pivot member.

11. A tool set comprising a plurality of tools, each having a pair of integrally connected, elongate shanks disposed at a substantial angle relative to each other with each shank having a working part at its outer end, an elongate tool-holding body including means defining an elongate channel extending longitudinally thereof, said channel having an elongate base and an open side extending longitudinally of said channel opposite said base for receiving tools in stored positions with one shank of each tool adjacent and substantially paralleling the base of the channel and the other shank of each tool extending outwardly from said base through said open side of the channel, and permitting shifting of a tool between said stored position, a first working position shifted longitudinally of said body whereby said other shank portion of the tool is spaced from the body with its associated working part exposed, and a second working position wherein said one shank portion of the tool is shifted outwardly from said body and said other tools to expose its associated working part, and holding means in said body for holding a tool in a selected position, said holding means comprising a pivot member secured to said body, extending laterally of said channel, spaced outwardly from said base and overlying one shank of a tool in said channel when the tool is in its stored position and providing a pivot about which the tool may be swung to place the tool in its second working position with its said one shank extending outwardly at a substantial angle from said channel and its other shank captured between said pivot member and the base of said channel, and means frictionally engaging a tool shank in said channel yieldably to hold the same in a selected position in said channel.

12. The tool set of claim 11, wherein said means frictionally engaging a tool shank comprises means for engaging opposed sides of a tool shank facing laterally of said channel to inhibit shifting of the tool shank laterally of said channel.

13. The tool set of claim 12, wherein a tool shank has a plurality of angularly disposed, substantially planar sides extending longitudinally of the shank and said holding means comprises means for engaging a pair of opposed sides of a tool shank and holding said tool shank against rotation about a pivot axis extending longitudinally of said tool-holding body.

* * * * *